US009322176B2

(12) United States Patent
Kelly

(10) Patent No.: US 9,322,176 B2
(45) Date of Patent: Apr. 26, 2016

(54) SUSTAINABLE ENERGY EFFICIENT ROOF SYSTEM

(71) Applicant: Thomas L. Kelly, Waterbury, CT (US)

(72) Inventor: Thomas L. Kelly, Waterbury, CT (US)

( * ) Notice: Subject to any disclaimer, the term of this patent is extended or adjusted under 35 U.S.C. 154(b) by 0 days.

(21) Appl. No.: 14/791,609

(22) Filed: Jul. 6, 2015

(65) Prior Publication Data

US 2016/0010336 A1 Jan. 14, 2016

Related U.S. Application Data

(60) Provisional application No. 62/022,535, filed on Jul. 9, 2014.

(51) Int. Cl.

| | |
|---|---|
| ***E04B 5/00*** | (2006.01) |
| ***E04D 11/02*** | (2006.01) |
| ***E04D 3/02*** | (2006.01) |
| ***E04D 3/35*** | (2006.01) |
| ***E04D 3/36*** | (2006.01) |
| ***E04D 5/00*** | (2006.01) |
| ***E04D 5/14*** | (2006.01) |
| ***E04D 13/00*** | (2006.01) |

(52) U.S. Cl.

CPC *E04D 11/02* (2013.01); *E04D 3/02* (2013.01); *E04D 3/352* (2013.01); *E04D 3/3605* (2013.01); *E04D 5/00* (2013.01); *E04D 5/148* (2013.01); *E04D 13/00* (2013.01)

(58) Field of Classification Search

CPC ..... E04D 11/02; E04D 3/3605; E04D 13/00; E04D 5/148; E04D 3/02; E04D 3/352; E04D 5/00

USPC ..... 52/62, 408, 409, 410, 420, 746.11

See application file for complete search history.

(56) References Cited

U.S. PATENT DOCUMENTS

| | | | | | |
|---|---|---|---|---|---|
| 4,016,323 | A * | 4/1977 | Volovsek | B23B 5/18 | 156/78 |
| 4,112,632 | A * | 9/1978 | Simpson | E04B 7/105 | 52/11 |
| 4,489,531 | A * | 12/1984 | Nelson | E04D 11/02 | 52/199 |
| 4,557,081 | A * | 12/1985 | Kelly | E04D 5/14 | 52/199 |
| 4,706,432 | A * | 11/1987 | Fishburn | E04D 5/142 | 277/654 |
| 4,937,990 | A * | 7/1990 | Paquette | E04D 13/172 | 52/199 |
| 5,031,374 | A * | 7/1991 | Batch | E04D 3/3603 | 52/22 |
| 5,253,461 | A * | 10/1993 | Janoski | E04D 11/02 | 156/71 |
| 5,740,647 | A * | 4/1998 | Kelly | E04D 11/02 | 52/199 |
| 6,006,482 | A * | 12/1999 | Kelly | E04D 13/1407 | 52/409 |
| 6,237,293 | B1 * | 5/2001 | Gembala | E04D 13/0431 | 52/302.6 |

(Continued)

*Primary Examiner* — Syed A Islam
*Assistant Examiner* — Joshua Ihezie
(74) *Attorney, Agent, or Firm* — Cantor Colburn LLP

(57) ABSTRACT

A roof system is provided including a roof deck and a first waterproofing membrane disposed upwardly adjacent the roof deck. A channel member is arranged over a portion of the first waterproofing membrane near a perimeter of the roof system. The channel member is secured to the roof deck with a plurality of fasteners. Insulation is arranged upwardly adjacent the first waterproofing membrane A weighted cover board is disposed on top of the insulation. A portion of the insulation and the weighted cover board is arranged within the cavity of the channel member. The first waterproofing membrane surrounds the channel member and extends over a portion of an upper surface of the weighted cover board. A second waterproofing membrane is positioned upwardly adjacent the weighted cover board. The second waterproofing membrane overlaps the portion of the first waterproofing membrane extended over the weighted cover board.

18 Claims, 5 Drawing Sheets

(56) References Cited

U.S. PATENT DOCUMENTS 6,286,280 B1 * 9/2001 Fahmy ..... E04D 5/10 428/461
6,751,923 B1 * 6/2004 Nunley ..... E04D 3/40 52/276
6,945,005 B2 * 9/2005 Nunley ..... E04D 13/15 52/60
7,802,403 B2 * 9/2010 Finnerty ..... E04B 1/70 52/412
8,136,319 B2 * 3/2012 Kelly ..... E04D 11/02 52/408
8,407,945 B2 * 4/2013 Kelly ..... E04D 13/155 52/300
8,484,922 B2 * 7/2013 Lee ..... B32B 5/18 428/316.6
2002/0178671 A1 * 12/2002 Gembala ..... E04D 3/405 52/302.6
2006/0010808 A1 * 1/2006 Kelly ..... E04D 13/1643 52/409
2006/0053718 A1 * 3/2006 Kelly ..... E04D 13/1643 52/409
2007/0261346 A1 * 11/2007 Kelly ..... E04D 13/155 52/408
2013/0174510 A1 * 7/2013 Kelly ..... E04G 21/00 52/741.4

* cited by examiner

SUSTAINABLE ENERGY EFFICIENT ROOF SYSTEM

CROSS-REFERENCE TO RELATED APPLICATION

This application claims the benefit of U.S. provisional patent application Ser. No. 62/022,535 filed Jul. 9, 2014, the entire contents of which are incorporated herein by reference.

BACKGROUND

Exemplary embodiments of the invention relate to a roof system, and more particularly, to a sealed roof system.

Roofing systems use waterproof membrane to prevent water from entering into the building. Large sheets of such membranes are welded or glued to one another, depending on the material of the membrane, to form continuous sheets that cover the entire surface of the roof. Membranes generally require termination of one kind or another at a perimeter edge of the roof. Because the perimeter edge of the roof is an area that experiences forces that act in different directions as well as being an area where wind vortices create low pressure regions, the roof is prone to expansion and contraction as well as wind failure in this area. Parapet walls and sheet metal gutters, gravel stops and fascia finishes can leak in this area damaging conventional perimeter membrane terminations.

Typical edge terminations, such as nailers, termination bars, reinforced membrane strips, and fasteners are prone to failure for mainly two reasons. First, the pulling of the membrane due to high winds eventually tears the membrane at the stress concentration points created by discrete or non-uniform areas of membrane retention. Second, moisture finds its way to the boards in which the retaining features are embedded, causing rotting that eventually results in the fasteners coming loose from the boards. Once the membrane is no longer retained at the perimeter of the roof, winds can easily peel it away allowing water from rain and snow to enter the building through the unprotected roof.

BRIEF SUMMARY OF THE INVENTION

According to one embodiment of the invention, a roof system is provided including a roof deck and a first waterproofing membrane disposed upwardly adjacent the roof deck. A channel member is arranged over a portion of the first waterproofing membrane near a perimeter of the roof system. The channel member is secured to the roof deck with a plurality of fasteners. Insulation is arranged upwardly adjacent the first waterproofing membrane A weighted cover board is disposed on top of the insulation. A portion of the insulation and the weighted cover board is arranged within the cavity of the channel member. The first waterproofing membrane surrounds the channel member and extends over a portion of an upper surface of the weighted cover board. A second waterproofing membrane is positioned upwardly adjacent the weighted cover board. The second waterproofing membrane overlaps the portion of the first waterproofing membrane extended over the weighted cover board.

According to another embodiment of the invention, a method of sealing a roof system is provided including adhering a first waterproofing membrane upwardly adjacent a roof deck. A channel member arranged on top of the first waterproofing membrane adjacent a perimeter of the roof system is fastened to the roof deck. Insulation is installing on top of the first waterproofing membrane. Weighted cover board is installed upwardly adjacent the insulation. A portion of both the insulation and the weighted cover board is arranged within a cavity of the channel member. The first waterproofing membrane is wrapped around the channel member and over a portion of the weighted cover board. A second waterproofing membrane is installed over the weighted cover board and overlaps a portion of the first waterproofing membrane on top of the weighted cover board.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1:
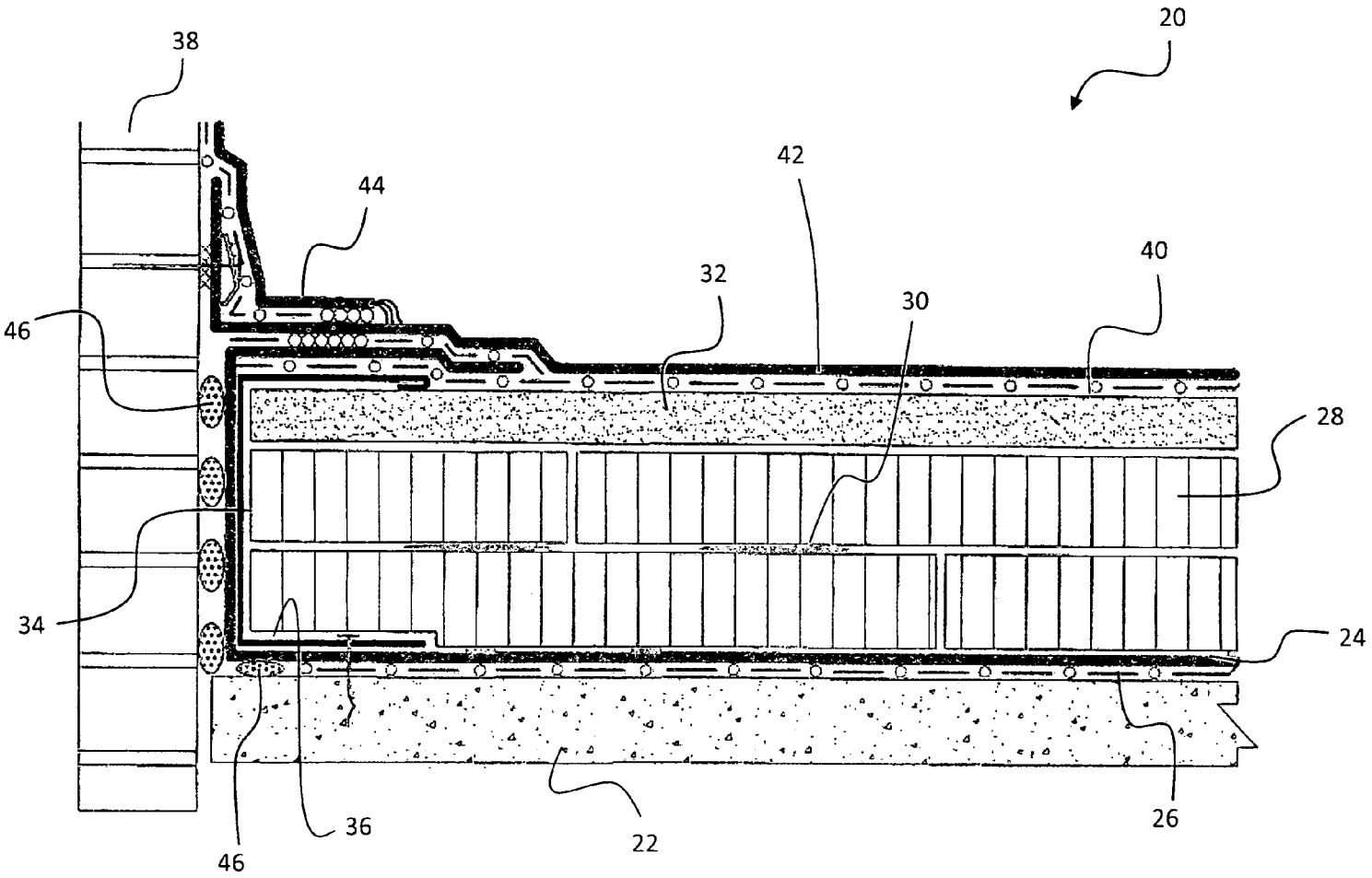
FIG. 1 is a cross-sectional elevation view of a roof system according to an embodiment of the invention.

Referring now to FIG. 1, the illustrated embodiment of a roof system 20 includes a roof deck 22, such as formed from poured in place concrete for example. It will be understood by a person of ordinary skill in the art that other types of decks formed from either an air permeable or a non-air permeable material, including, but not limited to, tectum, gypsum, composite, wood, precast (FIG. 2), and corrugated metal (FIG. 4) for example, are within the scope of the invention. A first waterproofing membrane 24 is positioned upwardly adjacent the roof deck 22. In the illustrated, non-limiting embodiment, the first waterproofing membrane 24 is fully adhered to the roof deck 22, such as with a layer of vapor barrier adhesive 26 for example. The membrane 24 may be made of ethylene propylene diene monomer (EPDM), chlorosulfonated polyethylene (CSPE), polyvinyl chloride (PVC) or other similar roof waterproofing single ply membranes. In addition, each membrane described herein may include a plurality of layered single ply membranes.

Insulation 28 is layered above the upwardly adjacent the first waterproofing membrane 24. The insulation 28 may be formed from polyisocyanurate or expanded or extruded polystyrene as well as other insulating materials common to the roofing industry. Although two layers of insulation 28 are illustrated in FIG. 1, embodiments including only a single layer of insulation or additional stacked layers of insulation are within the scope of the invention. The insulation 28 may be "loose laid" and therefore is not mechanically or chemically fastened to the first waterproofing membrane 24 or the structural roof beam 22. Alternatively, the at least one layer of insulation 28 may be locally attached to the first waterproofing membrane 24, or an adjacent layer of insulation, such as with an adhesive, liquid nail, or spray foam for example 30.

Positioned upwardly adjacent the one or more layers of insulation 28 is a weighted cover board 32 configured to hold the insulation 28 in place. The weighted cover board or ballast 32 has a substantially uniform weight across the entire roofing system, regardless of its position relative to a perimeter thereof. The weight of the cover board 32 is intended to prevent movement of the insulation 28 in windy conditions and also to provide a surface on which building personnel may stand and/or work. The cover board 32 generally has a weight of about 4 lbs/ft$^2$ (is there a range, must it be less than weight of conventional ballast?) and comprises one or more of acrylic, concrete, cement, gypsum, oriented strand board, plywood, rigid fiber board, or other solid board material. Specific examples of cover boards 32 include, but are not limited to, an acrylic concrete board, a cement tile board, a cement topped insulation board, DensDeck®, STRUCTODEK®, SECUROCK®, DUROCK®, PermaBase®, WonderBoard®, LIGHTGUARD®, and HEAVYGUARD® for example. The weighted cover board 32 may additionally have properties such that it holds it shape, even while being pulled non-uniformly by attachments to the roof and building structures for example. Because of this tendency to retain its shape, the cover board 32 evenly distributes loads applied thereto to minimize localized stress levels.

Surrounding a first end 34 of each of the one or more layers of insulation 28 and the cover board 32, is a channel member 36. Though a channel member 36 consisting of a C-channel is illustrated, channel members 36 having other configurations, such as a U-channel for example, is within the scope of the invention. A portion of the channel member 36, such as the portion adjacent the roof deck 22 for example, may be secured thereto with a plurality of staggered fasteners. In the illustrated, non-limiting embodiment, the ends 34 of the insulation 28 and cover board 32 closest to a perimeter of the roof system 20 are received within the central cavity of the channel member 36. The first waterproofing membrane 24 is configured to substantially surround the exterior of the channel member 36 and connect to an upper surface 40 of the cover board 32. In some embodiments, a portion of the layer of insulation 28 directly adjacent the first waterproofing membrane 24 may be removed to accommodate part of the channel member 36 such that the insulation 28 and cover board 32 remain substantially level.

A second waterproofing membrane 42 is positioned over and adhered to the upper surface 40 of at least a portion of the weighted cover board 32. As is illustrated in the FIGS., the second waterproofing membrane 42 generally overlaps the portion of the first waterproofing membrane 24 wrapped about the channel member 36 and extending over the cover board 32. Additional flashing material 44 may extend from a surface of the second waterproofing membrane 42 and couple to a wall 38 adjacent the perimeter of the roof system 20.

As illustrated in FIG. 1, a sealant 46, such as a non-curable mastic, urethane, caulk, seam tape, elastomeric coating, or spray foam for example, is positioned at the perimeter of the roof system 20 between the wall 38 and the portion of the first waterproofing membrane 24 surrounding the channel member 36. The sealant 46 additionally extends around the channel member 36 between the first waterproofing membrane 24 and the roof deck 22 to further seal the deck 22.

A person having ordinary skill in the roofing art will recognize that this application does not disclose the use of adhesive material between the insulation 28 and the weighted cover board 32. Although it might be expected by one of ordinary skill in the art that such would be necessary, in the present system, such is not necessary and therefore the cost in materials and labor to install such materials can be avoided in this roof system 20.

Figure 2:
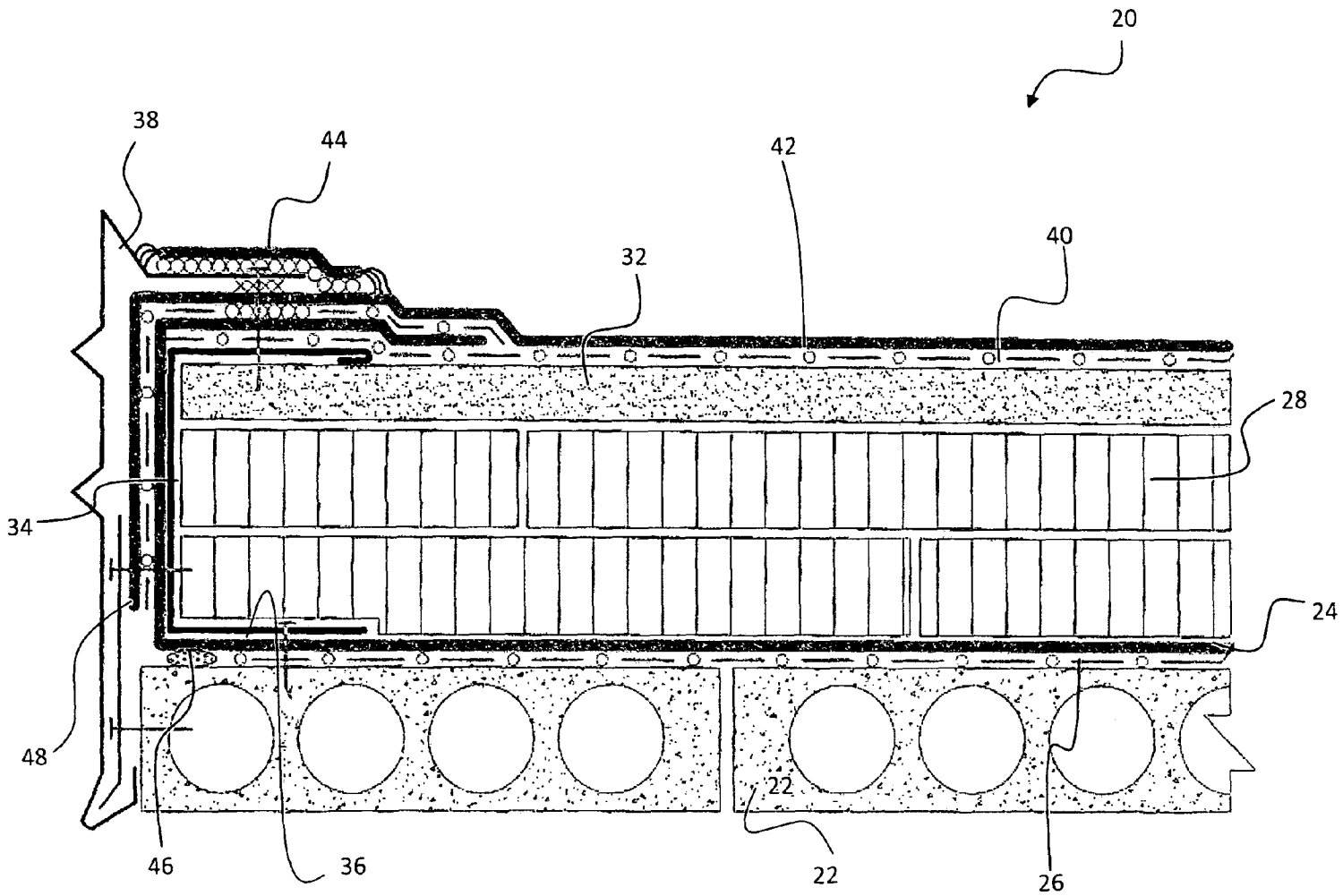
FIG. 2 is a cross-sectional elevation view of a roof system according to an embodiment of the invention.

Another embodiment of the roof system 20 is illustrated in FIG. 2. In the illustrated, non-limiting embodiment, the second waterproofing membrane 42 not only extends over the portion of the first membrane 24 overlapping the cover board 32, but also wraps at least partially about the channel member 36 in the direction of the roof deck 22. A fastener may be used to retain the free end 48 of the second waterproofing membrane 42 to the adjacent first waterproofing membrane 24 and insulation 28. In such embodiments, sealant 46 may be positioned between the second waterproofing membrane 42 and the adjacent wall 38 as well as between the first waterproofing membrane 24 and the roof deck 22 adjacent the channel member 36 to seal the deck 22.

Figure 3:
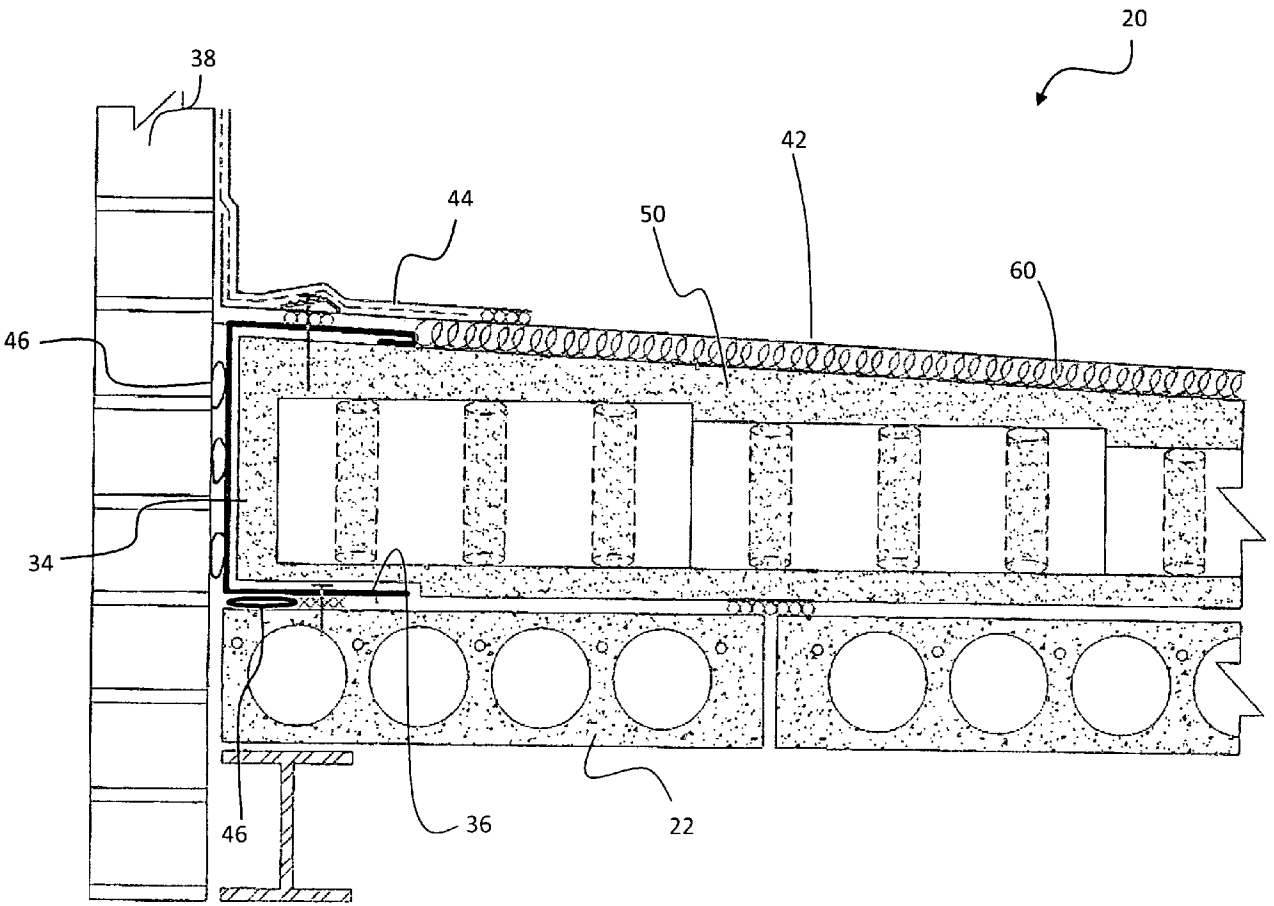
FIG. 3 is a cross-sectional elevation view of a roof system according to an embodiment of the invention.

In yet another embodiment illustrated in FIG. 3, the insulation 28 and cover board 32 are replaced with a flat or tapered lightweight, cellular, insulating concrete material 50. Similar to the insulation 28, a portion of the insulating concrete material 50, generally complementary to a portion of the channel member 36, may be cut away to receive the channel member 36. The roof system 20 of FIG. 3 may, but need not include the first waterproofing membrane 24 arranged between the roof deck 22 and the insulating concrete material 50 and channel member 36 (as shown). In the absence of the first waterproofing membrane 24, the sealant 46 extends directly between a surface the channel member 36 and the adjacent wall 38 and roof deck 22. The embodiment illustrated in FIG. 3, additionally includes an optional separator mat 60 positioned between the insulating concrete material 50 and the second waterproofing membrane 42 to protect the membrane 42.

Figure 4:
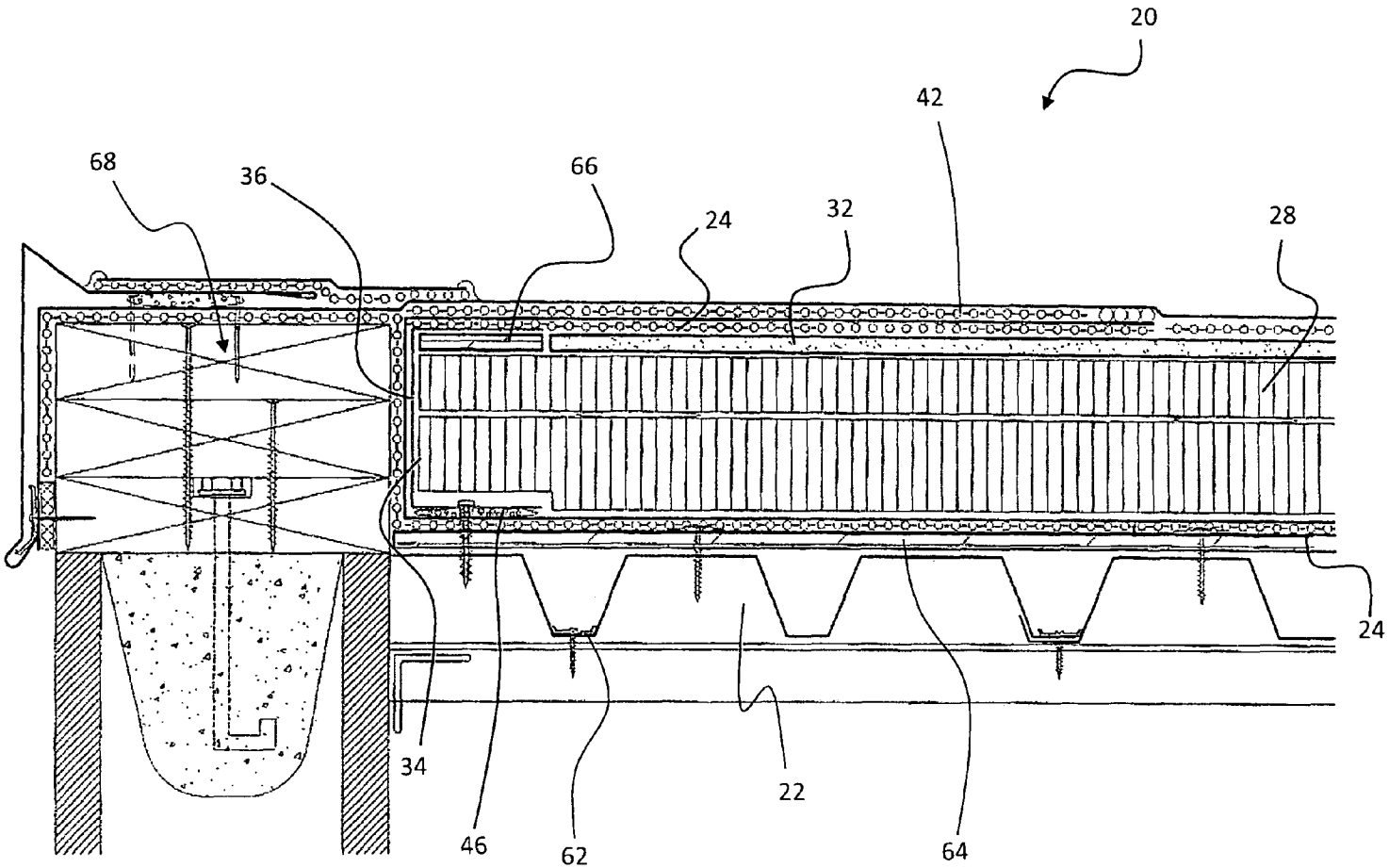
FIG. 4 is a cross-sectional elevation view of a roof system according to an embodiment of the invention.

The roof system 20 illustrated in FIG. 4 includes a roof deck 22 constructed from multiple metal corrugate panels overlapped at overlap flutes 62. In one embodiment, a sealant material (not shown), such as polyurethane foam for example, is applied to the overlapping flute sections 62. A layer of plywood sheathing or cement board 64 is mechanically fastened upwardly adjacent the roof deck 22. The remainder of the roof system 20 is substantially similar to the systems of FIGS. 1 and 2, and includes a first waterproofing membrane 24, at least one layer of insulation 28, a cover board 32, and a second waterproofing membrane 42. An end 34 of the insulation 28 and cover board 32 is received within a channel member 36 installed near a perimeter of the roof system 20. In one embodiment, a spacer 66 having a thickness substantially identical to the cover board 32 is positioned directly adjacent the upper surface 40 of the cover board 32 within the channel member 36. As previously described, the first waterproofing membrane 24 wraps around the channel member 36 and extends over a portion of the cover board 32 and the second waterproofing membrane 42 similarly overlaps the first waterproofing membrane 24. Sealant 46 may be positioned between the channel member 36 and the adjacent first waterproofing membrane 24 (as shown), or alternatively, may be located between the first waterproofing membrane 24 and the cement board 64, directly adjacent the channel member 36. Sealant 46 may also be arranged between the first waterproofing membrane 24 and an adjacent nailer 68 for example.

Figure 5:
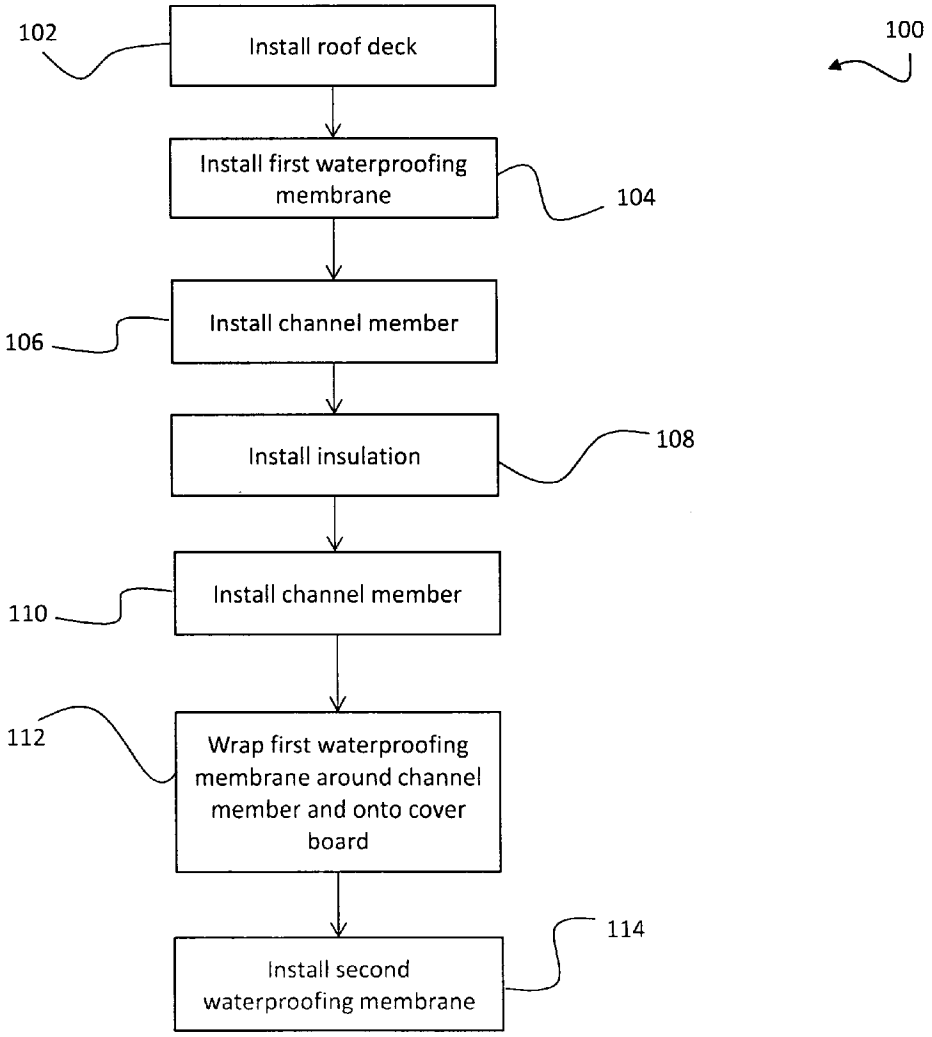
FIG. 5 is a block diagram of a method of sealing a perimeter and/or roof deck junction of a roof system according to an embodiment of the invention.

Referring now to FIG. 5, a method 100 for sealing perimeters and junctions of a roof deck is illustrated in more detail. In block 102, a roof deck 22 of the roof system 20 is installed. In embodiments where the roof deck 22 includes a plurality of overlapping panels, installation of the roof deck 22 includes installation of a plurality of plywood or cement boards arranged perpendicular to the overlap joints. A first waterproofing membrane 24 is adhered to the roof deck 22 in block 104. In block 106, a channel member 36 is mechanically fastened to the roof deck 22. In one embodiment, installation of the channel member 36 includes positioning a sealant 46 generally between the channel member 36 and the adjacent first waterproofing membrane 24.

In block 108, at least one layer of insulation 28 is installed, such as in a "loosely laid" configuration, onto the waterproofing membrane 24. The insulation 28 is ballasted in place with a "loosely laid" layer of weighted cover board 32 in block 110. A portion of the cover board 32 and the insulation 28 are arranged within the channel member 36. In one embodiment, installation of the cover board 32 may additionally include positioning a complementary spacer 66, such as formed from plywood for example, within the channel member 36. In block 112, the free end of the first waterproofing membrane 24 is wrapped about the channel member 36 such that the membrane 24 extends over at least a portion of the surface 40 of the cover board 32. When the first membrane 24 is wrapped about the channel member 36, a sealant 46 may be positioned between the first membrane 24 and the roof deck 22 and as well as between the first membrane 24 and an adjacent wall 38, such as a parapet wall or nailer for example. In block 114, a second waterproofing membrane 114 is installed in an overlapping arrangement over the first waterproofing membrane 24 and the channel member 36.

Inclusion of a first waterproofing membrane surrounding the channel member and a sealant seals the roof deck 22 from penetrating air flowing vertically and horizontally through the roof system 20. In addition, because the roof system 20 is sealed, the convection of hot air from the ceiling of the building through the roof system 20 is significant reduced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A roof system, comprising:

a roof deck;

a first waterproofing membrane upwardly adjacent the roof deck;

a channel member arranged over a portion of the first waterproofing membrane near a perimeter of the roof system, the channel member being secured to the roof deck with a plurality of fasteners;

insulation arranged upwardly adjacent the first waterproofing membrane, a portion of the insulation being arranged within a cavity of the channel member;

a weighted cover board disposed on top of the insulation, a portion of the weighted cover board being positioned within the cavity of the channel member, wherein a portion of the first waterproofing membrane surrounds the channel member and extends over a portion of an upper surface of the weighted cover board; and a second waterproofing membrane arranged upwardly adjacent the weighted cover board and overlapping the portion of the first waterproofing membrane extended over the weighted cover board.

2. The roof system according to claim 1, wherein a sealant is arranged between the first waterproofing membrane and the roof deck adjacent the channel member.

3. The roof system according to claim 2, wherein the sealant is arranged between the first waterproofing membrane and an adjacent wall arranged at the perimeter of the roof system.

4. The roof system according to claim 1, wherein a sealant is arranged between a portion of the channel member and the adjacent first waterproofing membrane.

5. The roof system according to claim 1, wherein the first waterproofing membrane is adhered to the roof deck.

6. The roof system according to claim 1, wherein the weighted cover board is loosely laid over the insulation.

7. The roof system according to claim 1, wherein the insulation is loosely laid over the first waterproofing membrane.

8. The roof system according to claim 1, wherein the insulation is locally adhered to portions of the first waterproofing membrane.

9. The roof system according to claim 1, wherein the insulation includes multiple layers of insulation.

10. The roof system according to claim 9, wherein adjacent layers of insulation are locally adhered to one another.

11. The roof system according to claim 1, wherein a portion of the insulation is cut away to receive a complementary portion of the channel member.

12. The roof system according to claim 1, wherein the second waterproofing membrane wraps at least partially around the channel member towards the roof deck.

13. A method of sealing a roof system, comprising:

adhering a first waterproofing membrane to an adjacent roof deck;

fastening a channel member arranged on top of the first waterproofing membrane, adjacent a perimeter of the roof system, to the roof deck;

installing insulation on top of the first waterproofing membrane, a portion of the insulation being arranged within the channel member;

installing a weighted cover board upwardly adjacent the insulation, a portion of the weighted cover board being arranged within the channel member;

wrapping the first waterproofing membrane around the channel member and over a portion of the weighted cover board; and installing a second waterproofing membrane over the weighted cover board and overlapping a portion of the first waterproofing membrane on top of the cover board.

14. The method according to claim 13, further comprising arranging a sealant between a portion of the first waterproofing membrane and an adjacent wall at the perimeter of the roof system.

15. The method according to claim 13, further comprising arranging a sealant between a portion of the first waterproofing membrane and the roof deck adjacent the channel member.

16. The method according to claim 13, wherein the weighted cover board is loosely laid over the insulation.

17. The method according to claim 13, wherein the insulation is loosely laid over the first waterproofing membrane.

18. The method according to claim 13, wherein the insulation includes multiple layers, and adjacent layers of insulation are locally adhered to one another.

* * * * *